US010529505B2

(12) United States Patent
Yashima et al.

(10) Patent No.: US 10,529,505 B2
(45) Date of Patent: Jan. 7, 2020

(54) PUSH SWITCH

(71) Applicant: ALPS ALPINE CO., LTD., Tokyo (JP)

(72) Inventors: Yuki Yashima, Miyagi (JP); Izuru Sadamatsu, Miyagi (JP); Toshihiko Tazawa, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 15/882,096

(22) Filed: Jan. 29, 2018

(65) Prior Publication Data

US 2018/0151313 A1 May 31, 2018

Related U.S. Application Data

(63) Continuation of application No. PCT/JP2016/069169, filed on Jun. 28, 2016.

(30) Foreign Application Priority Data

Sep. 30, 2015 (JP) ..... 2015-194630

(51) Int. Cl.
*H01H 13/48* (2006.01)
*H01H 1/26* (2006.01)
(Continued)

(52) U.S. Cl.
CPC ..... *H01H 13/48* (2013.01); *H01H 1/26* (2013.01); *H01H 13/10* (2013.01); *H01H 13/14* (2013.01); *H01H 13/52* (2013.01)

(58) Field of Classification Search
CPC ..... H01H 13/48; H01H 1/26; H01H 13/10; H01H 13/14
(Continued)

(56) References Cited

U.S. PATENT DOCUMENTS 3,941,964 A * 3/1976 Yoder ..... H01H 13/7006 200/516
4,385,218 A 5/1983 Nishida
(Continued)

FOREIGN PATENT DOCUMENTS

EP 2194551 6/2010
JP H07-029728 U 6/1995
(Continued)

OTHER PUBLICATIONS

International Search Report dated Sep. 20, 2016 in PCT/JP2016/069169 filed on Jun. 28, 2016.
(Continued)

*Primary Examiner* — Edwin A. Leon
*Assistant Examiner* — Lheiren Mae A Caroc
(74) *Attorney, Agent, or Firm* — IPUSA, PLLC

(57) ABSTRACT

A push switch 1 includes a movable contact member 20 with a bulging portion 20*a*. The push switch 1 has a fixed contact member 10 with a first fixed contact portion 10*a* and a second fixed contact portion 10*b*. The push switch 1 includes an electrically conductive vibration damping member 25 elastically deformable by an operating force lower than load for inversion operation of the bulging portion 20*a*. When the movable contact member 20 is operated from the initial state, the vibration damping member 25 is deflected due to elastic deformation while the operating force during the elastic deformation of the vibration damping member 25 increases monotonically. When the movable contact member 20 returns from the bulging portion 20*a* being in an inverted state to the initial state, the vibration damping member 25 absorbs the vibrations from the movable contact member 20.

3 Claims, 9 Drawing Sheets

(51) Int. Cl.
*H01H 13/10* (2006.01)
*H01H 13/14* (2006.01)
*H01H 13/52* (2006.01)

(58) Field of Classification Search
USPC ..... 200/406, 513, 516
See application file for complete search history.

(56) References Cited

U.S. PATENT DOCUMENTS

| | | | | |
|---|---|---|---|---|
| 4,978,818 | A | 12/1990 | Rothlin | |
| 6,498,312 | B1 * | 12/2002 | Villain | H01H 13/64 200/406 |
| 2004/0026222 | A1 | 2/2004 | Adachi | |
| 2007/0039811 | A1 | 2/2007 | Yanai et al. | |
| 2008/0164133 | A1 * | 7/2008 | Hayafune | H01H 13/48 200/516 |
| 2013/0087443 | A1 | 4/2013 | Kikuchi | |

FOREIGN PATENT DOCUMENTS

| | | |
|---|---|---|
| JP | H11-096848 | 4/1999 |
| JP | 2004-031185 | 1/2004 |
| JP | 2005-044552 | 2/2005 |
| JP | 2005-056703 | 3/2005 |
| JP | 2007-52962 | 3/2007 |
| JP | 2010-146947 | 7/2010 |
| JP | 2013-093313 | 5/2013 |
| JP | 2017-079133 | 4/2017 |
| WO | 2016/181829 | 11/2016 |

OTHER PUBLICATIONS

Extended European Search Report for 16850778.8 dated Sep. 6, 2018.
Japanese Office Action for 2017-542940 dated Dec. 18, 2018.

* cited by examiner

PUSH SWITCH

CROSS-REFERENCE TO RELATED APPLICATIONS

This is a continuation of International Application No. PCT/JP2016/069169, filed on Jun. 28, 2016, which is based upon and claims the benefit of priority of the prior Japanese Patent Application No. 2015-194630, filed on Sep. 30, 2015, the entire contents of which are incorporated herein by reference.

FIELD

The present invention relates to a push switch including a movable contact member formed in a dome shape.

BACKGROUND

Push switches generating clicking feeling are used for various inputs. In the push switch in which a movable contact member is a metal dome, there is a case in which unintentional operation sound is generated when a pressing operation is stopped and the movable contact member returns to its initial state.

It is thought that releasing energy when the metal dome is reversed causes the movable contact member to collide with a fixed contact member or vibrations to be transmitted, etc., which in turn causes to the sound to be generated. If a movable contact member having a small operation load is used in order to reduce such an operation sound, the clicking feeling is changed, which is not preferable.

On the other hand, Patent Document 1 discloses a switch mechanism provided with a protrusion member formed of a rubber-like elastic body layer. FIG. 9 is a schematic sectional side view of the switch mechanism. As illustrated in FIG. 9, in this switch mechanism, a movable contact plate 113 is mounted on a switch substrate 110 on which a switch contact 111 is formed, a pressing plate 130 and a key top plate 140 are disposed thereon, and a case 170 is provided thereon to be covered. A switch contact 111 is provided at a position facing a key top 150. Above the switch contact 111, a movable contact plate 113 formed by forming a circular elastic metal plate into a dome shape is provided. As illustrated in FIG. 9, the pressing plate 130 is configured by attaching a protruding member 133 to a lower surface of a flat sheet-like flexible sheet 131. A protruding member 133 presses the movable contact plate 113 to invert the movable contact plate 113, which generates the clicking feeling, and the movable contact plate 113 comes into contact with the switch contact 111 to turn on the switch. The protrusion member 133 is formed by printing a rubber-like elastic layer on the lower surface of a flexible sheet 131.

When the movable contact plate 113 is pressed by the protrusion member 133 formed of the rubber-like elastic layer, sound and vibration hardly occur, and thus so-called sound elimination can be implemented.

CITATION LIST

[Patent Document 1] Japanese Laid-open Patent Publication No. H11-096848

However, in the case of the switch mechanism of Patent Document 1 described above, in order to make sound and vibration hard to occur, it is necessary to provide a rubber-like elastic layer separately. Therefore, there has been a demand for a push switch capable of achieving noise reduction with a simpler configuration without providing such a rubber-like elastic layer.

SUMMARY

According to one aspect of invention, A push switch is disclosed, which includes: a movable contact member formed of a metal plate and having a dome-shaped bulging portion, the bulging portion being capable of an inversion operation; a fixed contact member capable of electrically coupling to the movable contact member; a housing having a housing portion in which the movable contact member is accommodated, the housing portion having an opening at one side thereof; wherein the fixed contact member has a first fixed contact portion and a second fixed contact portion, the first fixed contact portion being provided on an internal bottom surface of the housing portion and capable of being brought into and out of contact with the movable contact member, the second fixed contact portion being provided at an outer edge portion of the internal bottom surface, the push switch further comprises an electrically conductive vibration damping member that is elastically deformable by an operating force lower than a load required for the inversion operation of the bulging portion, the bulging portion and the second fixed contact portion being electrically coupling to each other via the vibration damping member, when the movable contact member is operated from an initial state, the vibration damping member starts to elastically deform such that an operating force in an elastically deformed state increases monotonously, and when the bulging portion is returned to its initial state from an inverted state, the vibration damping member absorbs a vibration of the movable contact member

DESCRIPTION OF EMBODIMENTS

First Embodiment

In the following, embodiments of the present invention will be described in detail with reference to accompanying drawings. Note that, for the sake of clarity, the drawings are appropriately changed in dimensions.

Figure 1:
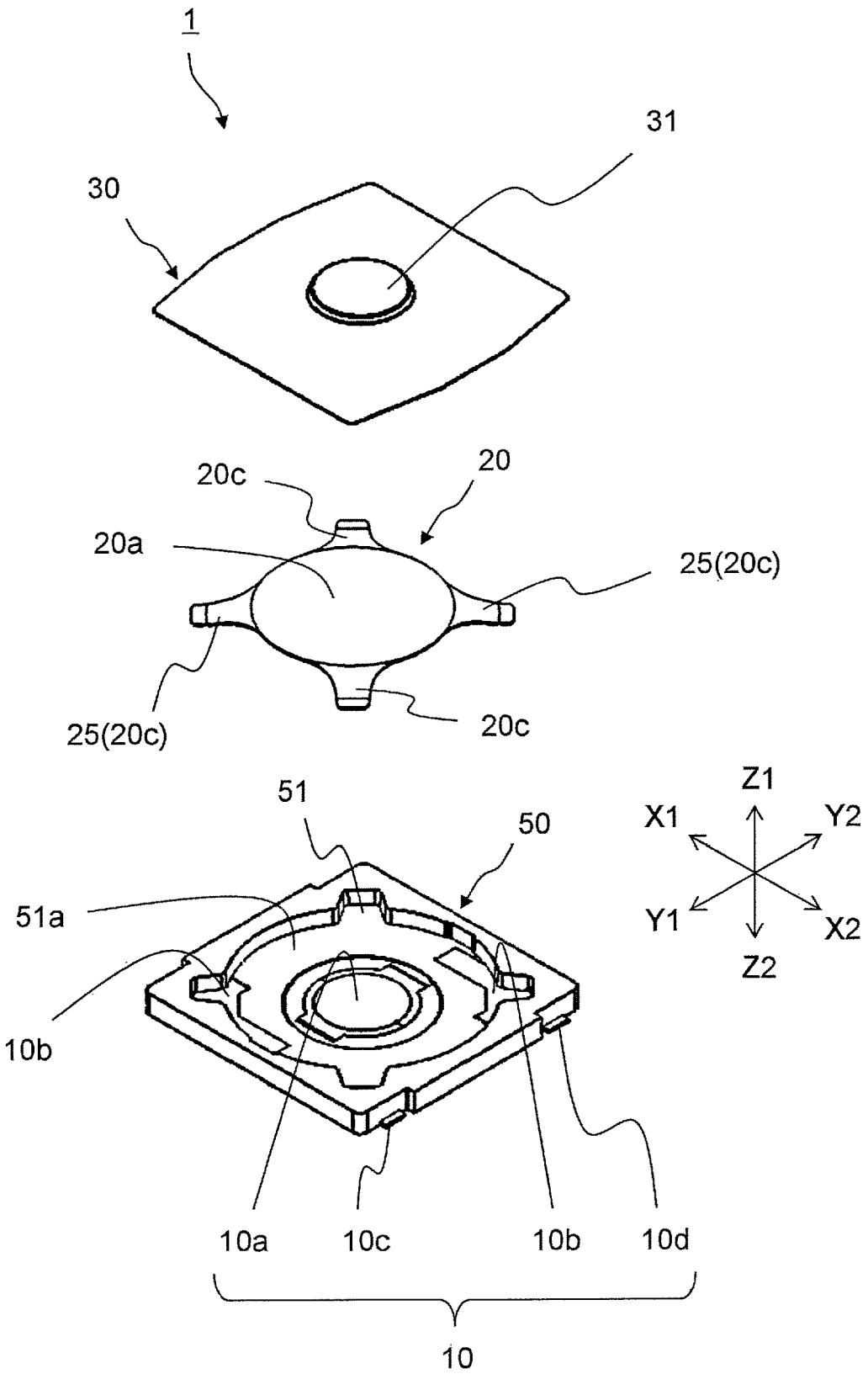
FIG. 1 is an exploded perspective view illustrating a push switch according to an embodiment of the present invention.
Figure 2:
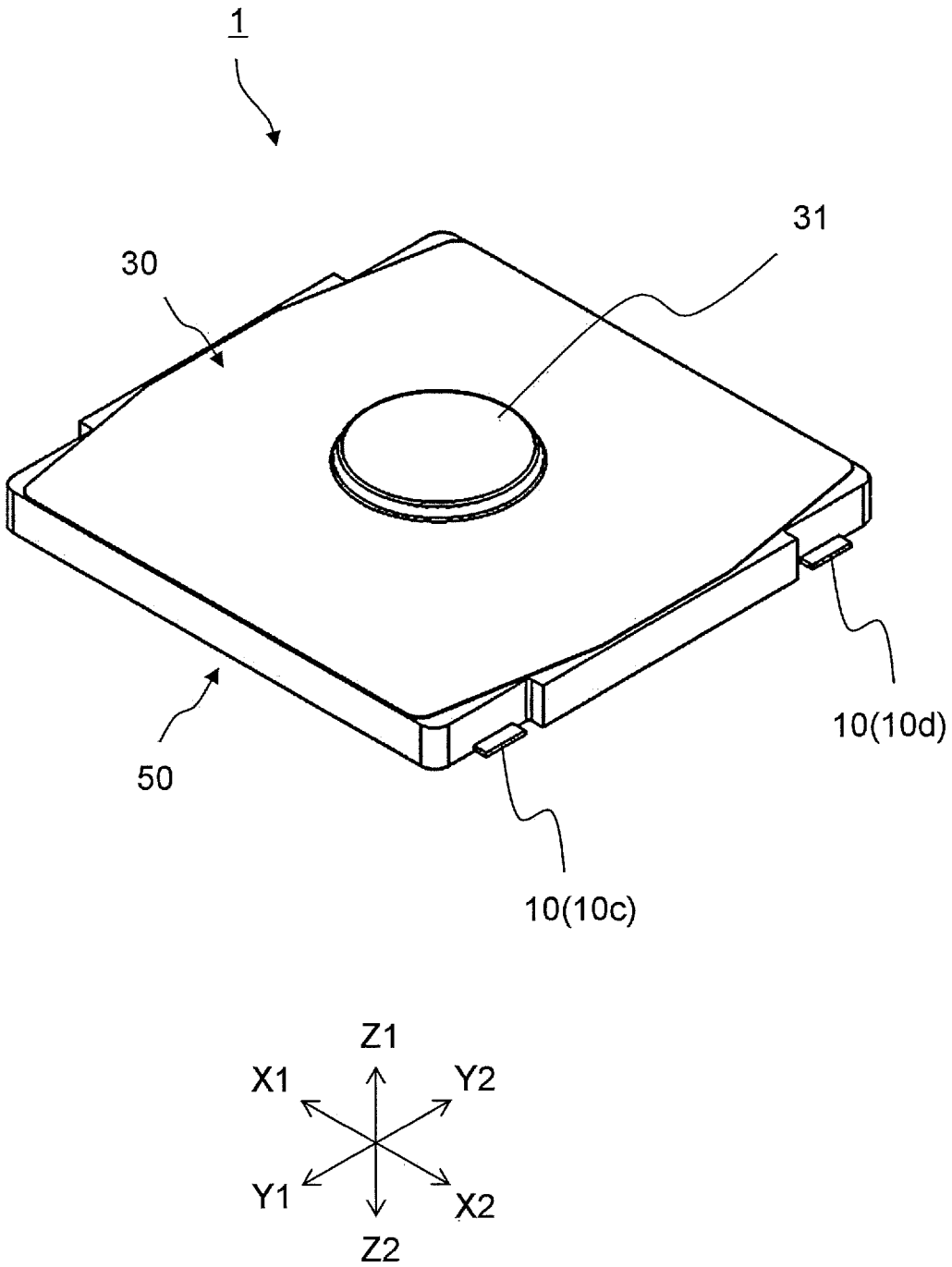
FIG. 2 is a perspective view illustrating the push switch according to the embodiment of the present invention.
Figure 3:
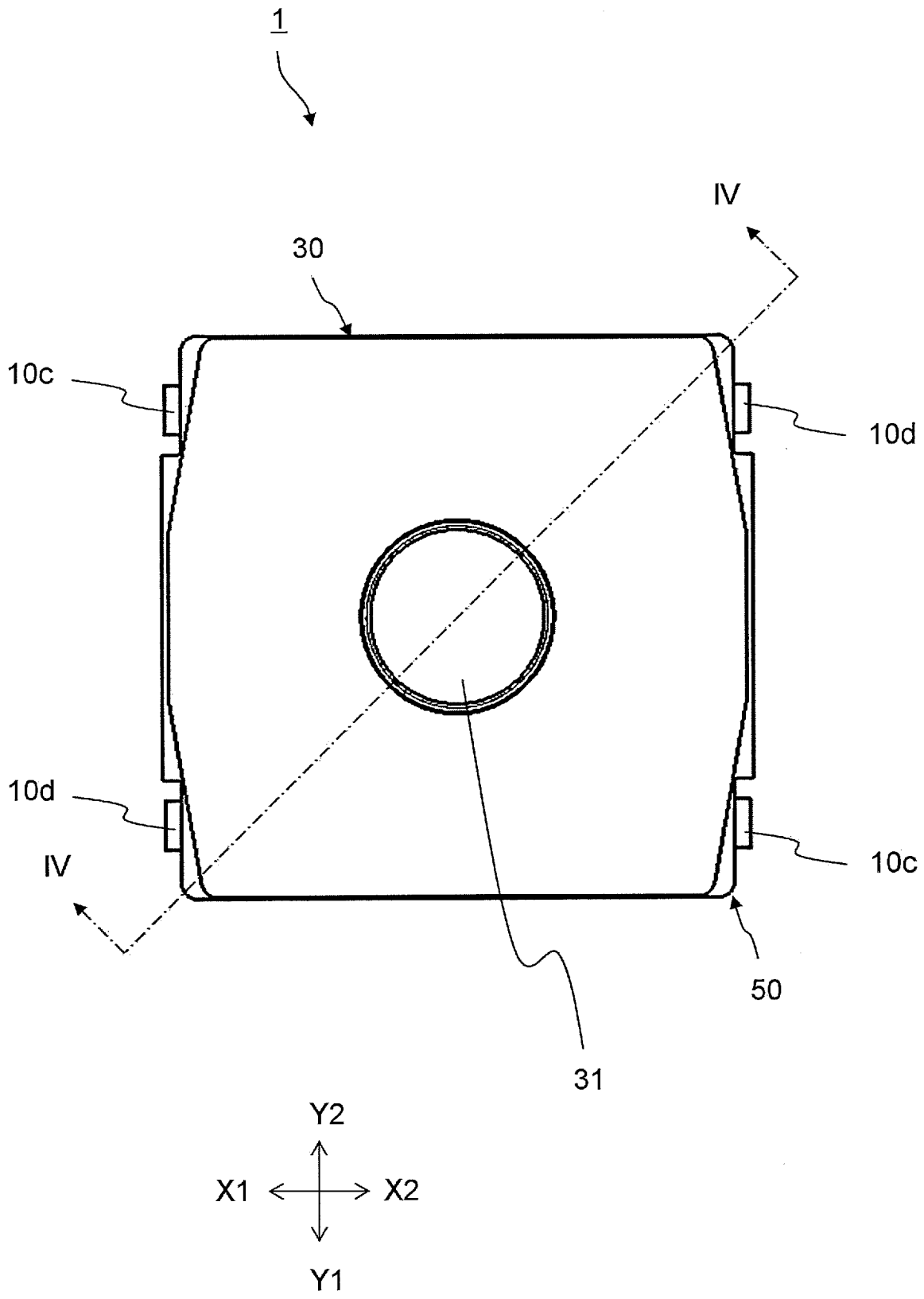
FIG. 3 is a plan view illustrating the push switch according to the embodiment of the present invention.
Figure 4A:
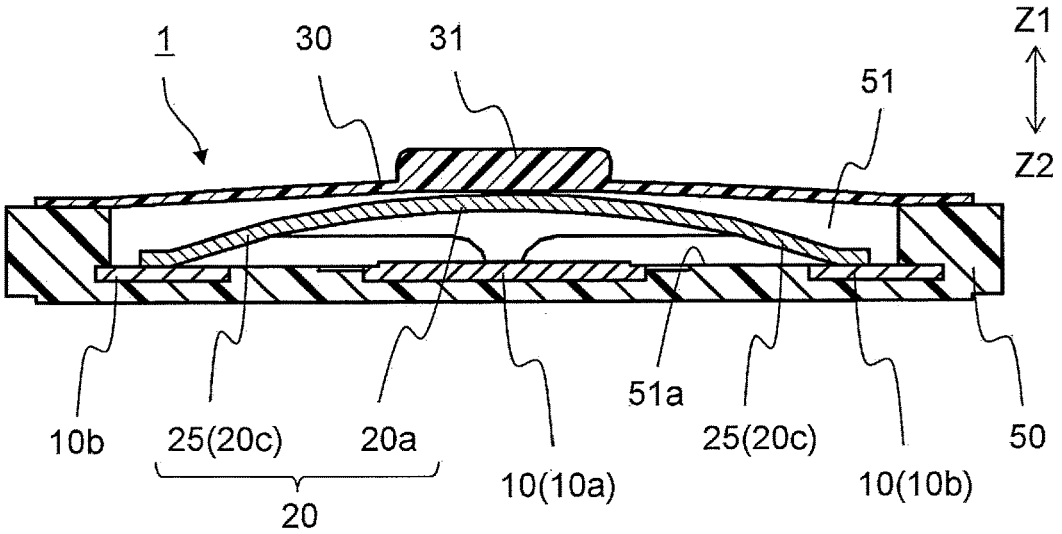
FIG. 4A is a sectional view taken along line IV-IV in FIG. 3 in an initial state.
Figure 4B:
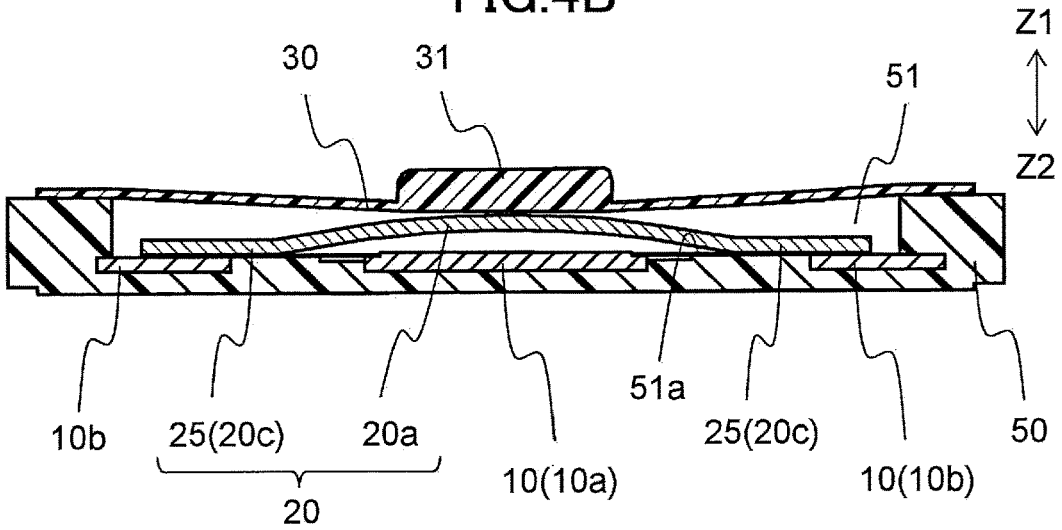
FIG. 4B is a sectional view taken along line IV-IV in FIG. 3 in a deflection state due to elastic deformation of a vibration damping member.
Figure 4C:
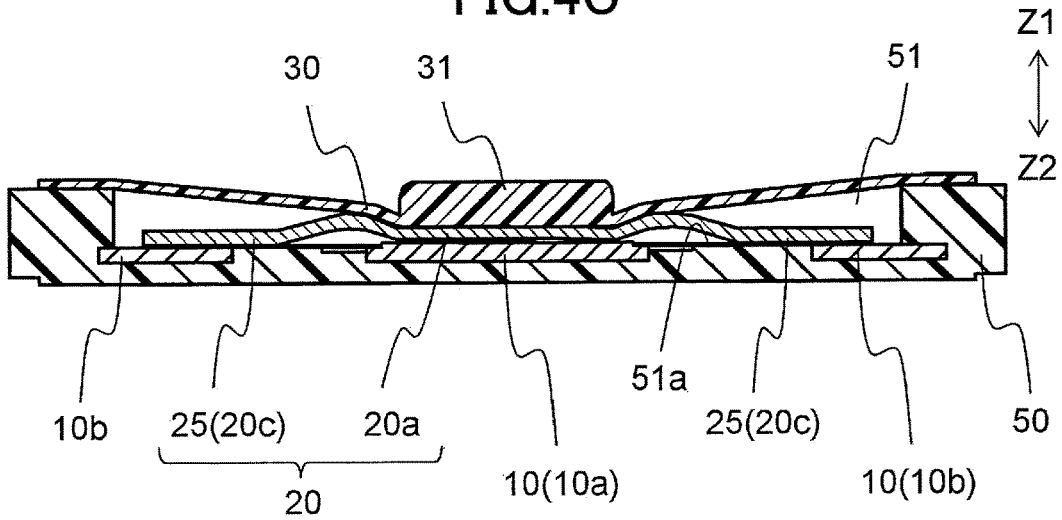
FIG. 4C is a sectional view taken along line IV-IV in FIG. 3 in a an inversion operation state.
Figure 5:
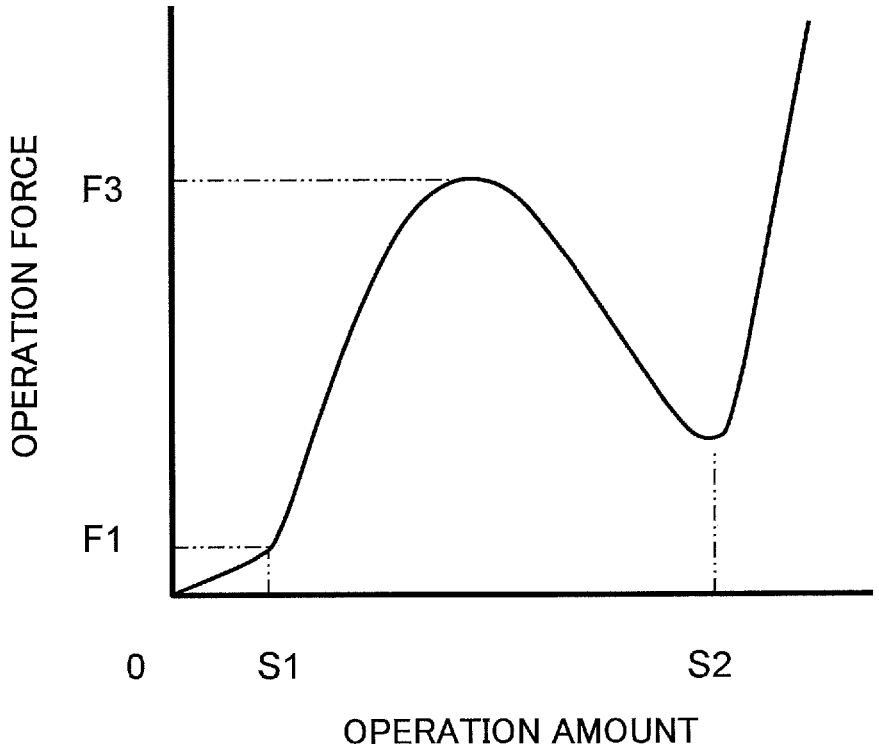
FIG. 5 is a graph illustrating a relationship between an operation amount and an operation force in a push switch according to the embodiment of the present invention.
Figure 6A:
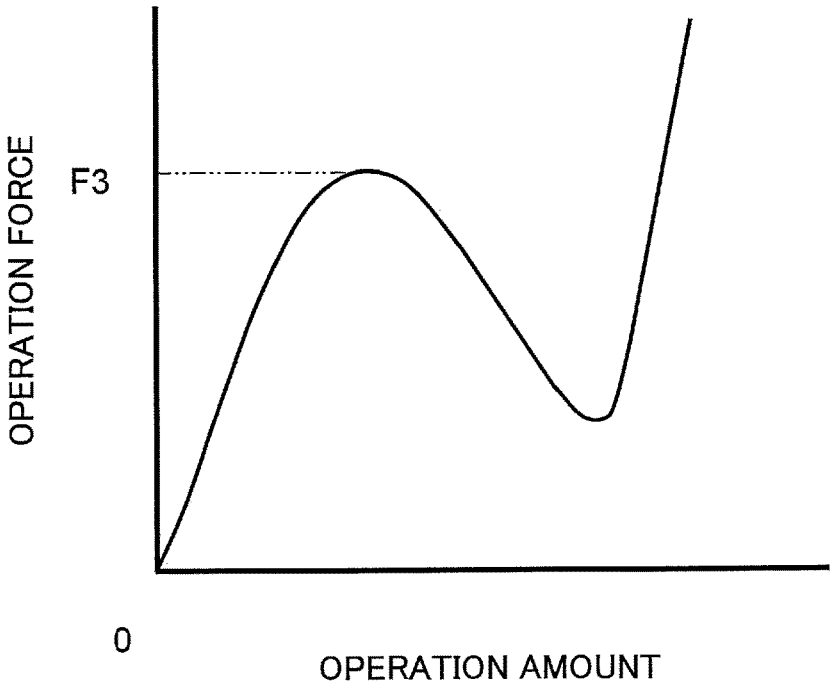
FIG. 6A is a graph illustrating the operation load of the bulging portion.
Figure 6B:
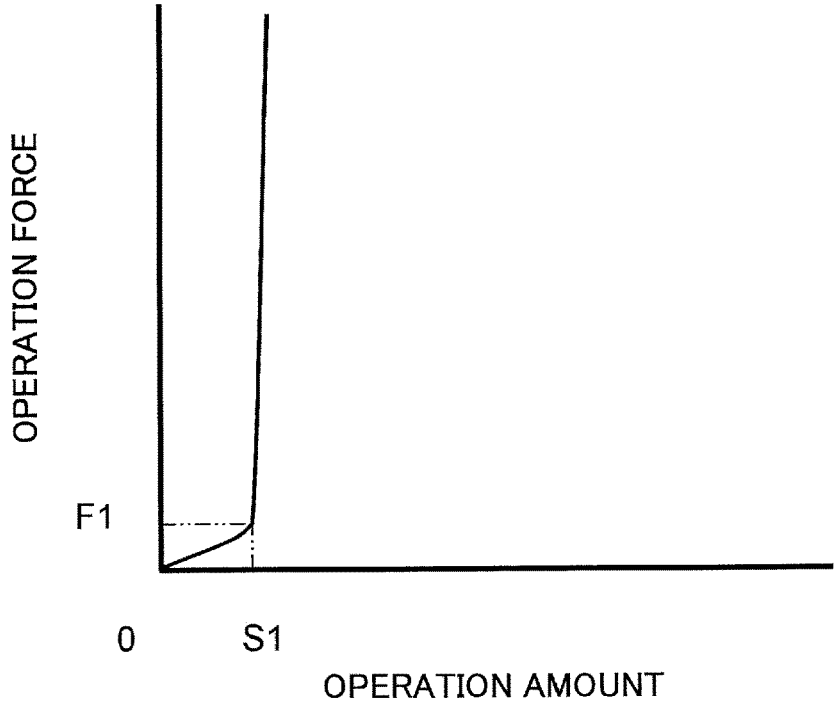
FIG. 6B is a graph illustrating the operation load of the vibration damping member.
Figure 8:
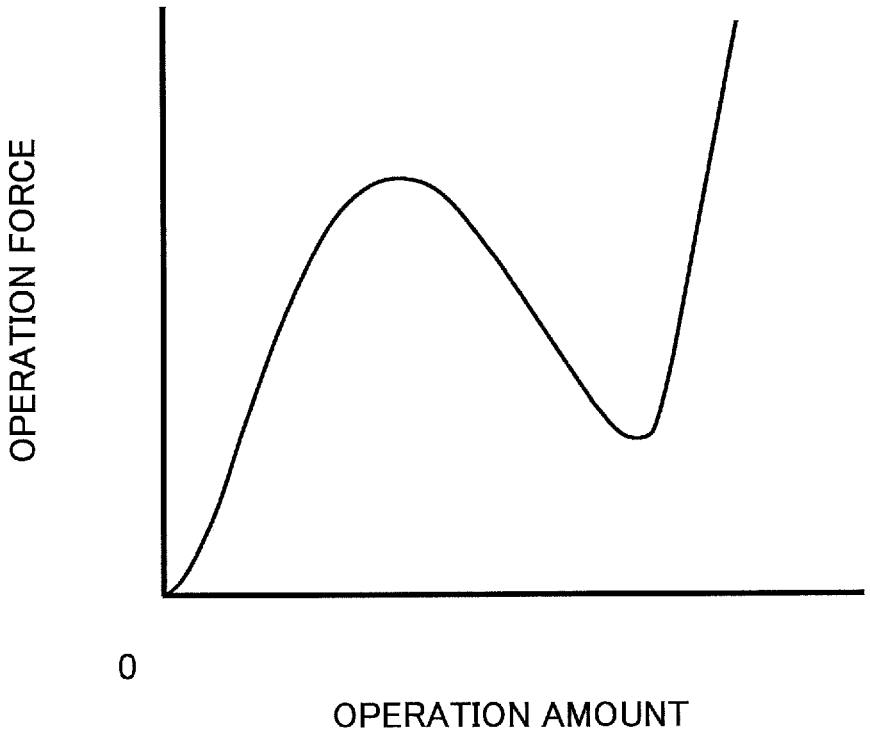
FIG. 8 is a graph illustrating a relationship between an operation amount and an operation force in a conventional push switch.
Figure 9:
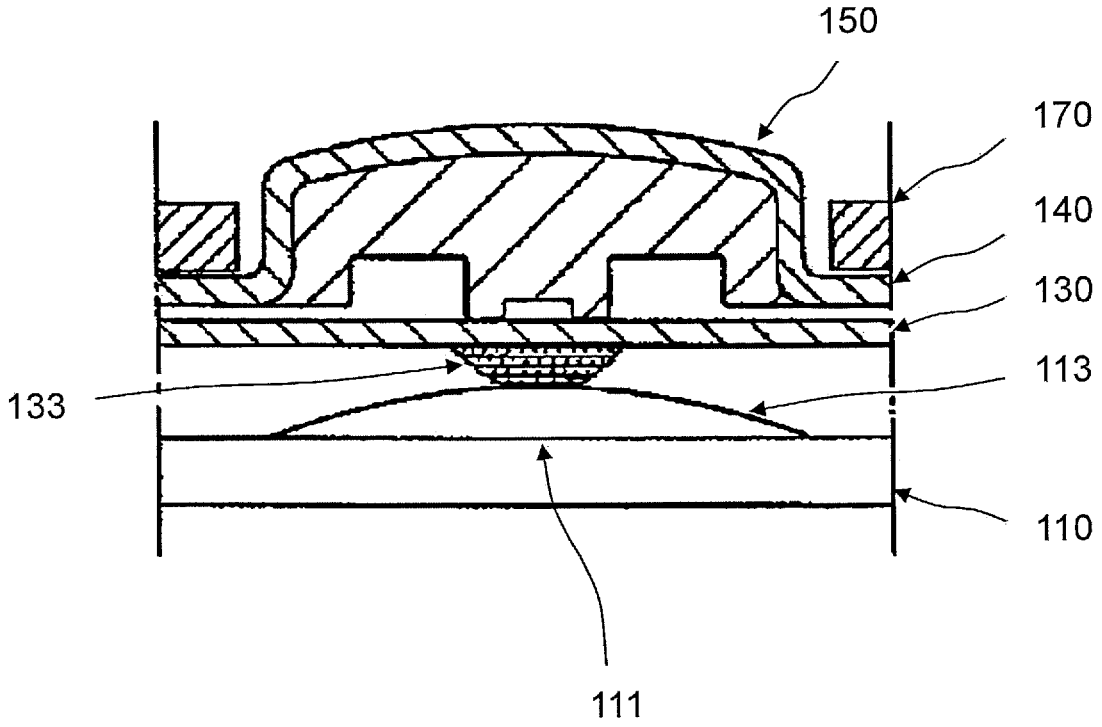
FIG. 9 is a schematic side sectional view of the conventional switch mechanism.

FIG. 1 is an exploded perspective view illustrating a push switch 1 according to an embodiment of the present invention. FIG. 2 is a perspective view illustrating an example of the push switch 1. FIG. 3 is a plan view illustrating the push switch 1. FIGS. 4A,4B,4C are sectional views taken along line IV-IV in FIG. 3, wherein FIG. 4A illustrates an initial state, FIG. 4B illustrates a deflection state due to elastic deformation of a vibration damping member 25, and FIG. 4C illustrates a sectional view of a bulging portion 20*a* in an inversion operation state. FIG. 8 is a graph illustrating a relationship between an operation amount and an operation force in the push switch 1. FIGS. 6A,6B are drawings for an operation principle for a combined operation force illustrated in FIG. 5, wherein FIG. 6A is a graph illustrating the operation load of the bulging portion 20*a*, and FIG. 6B is a graph illustrating the operation load of the vibration damping member 25.

As illustrated in FIGS. 1 to 4, the push switch 1 of the present embodiment is provided with a movable contact member 20, a fixed contact member 10 capable of electrically connecting to the movable contact member 20, a housing 50 with a housing portion 51 that has an opening on one side thereof, and a sheet member 30 that covers the housing portion 51.

The housing 50 is injection-molded using a synthetic resin of an insulating material and has a box-like outer shape having the opening on the Z1 side of the housing portion 51. In the housing 50, a fixed contact member 10 described hereinafter is embedded.

As illustrated in FIG. 1, the fixed contact member 10 is formed by a first fixed contact portion 10, which is provided at a central portion of an inner bottom surface 51*a* of the housing portion 51, and second fixed contact portions 10*b*, which are provided at an outer edge portion of the inner bottom surface 51*a*. Further, the fixed contact member 10 includes a first terminal portion 10*c* connected to the first fixed contact portion 10*a* and a second terminal portion 10*d* connected to the second fixed contact portions 10*b*. The first terminal portion 10*c* and the second terminal portion 10*d* are provided so as to be exposed outward from the side surface of the housing 50. Note that, since the housing 50 is formed of an insulating material, the first fixed contact portion 10*a* and the second fixed contact portions 10*b* are electrically insulated, and similarly, the first terminal portion 10*c* and the second terminal portion 10*d* are insulated from each other. The fixed contact member 10 and the housing 50 are integrated by, for example, insert molding.

The movable contact member 20 is formed by a conductive metal plate and accommodated in the housing portion 51. As illustrated in FIG. 1, the movable contact member 20 has a dome-shaped bulging portion 20*a* and leg portions 20*c* extending outward from the bulging portion 20*a*. In the initial state, the bulging portion 20*a* is in a convex form toward the Z1 side at the center, so that bulging portion 20*a* can be inversed by pressing from the Z1 side. The movable contact member 20 is disposed so that the leg portions 20*c* are in contact with the second fixed contact portions 10*b*, and the bulging portion 20*a* and the second fixed contact portions 10*b* are electrically connected in an initial state via the leg portions 20*c*.

The sheet member 30 is formed of a synthetic resin of an insulating material, and is arranged to cover the housing portion 51 so as to contact the bulging portion 20*a*. The sheet member is fixed to the housing 50 surrounding the housing portion 51. In the sheet member 30, a pressing portion 31 with an increased thickness is provided so as to face the central portion of the bulging portion 20*a*. The sheet member 30 is disposed so as to be in contact with the bulging portion 20*a*, and thus the bulging portion 20*a* of the movable contact member 20 can be stably inverted during the pressing operation. Further, since the sheet member 30 covers the housing portion 51, it is possible to prevent invasion of foreign matter which may interfere with an operation of the movable contact member 2. Note that, the pressing portion may be a separate member integrated with a synthetic resin sheet with a substantially uniform thickness by welding or adhesion. In this case, the material of the pressing portion 31 is not limited to the same material as the synthetic resin sheet, and the material can be appropriately selected from materials suitable for welding or bonding.

In the push switch 1 of the present embodiment, the four leg portions 20*c* are provided so as to be elastically deformable with an operation force lower than the reversing operation load of the bulging portion 20*a*. Note that, among the four leg portions 20*c*, two are not in contact with the second fixed contact portions 10*b*, and the other two establish electrical connection between the bulging portion 20*a* and the second fixed contact portions 10*b*.

As illustrated in FIG. 4 (*a*), in the initial state, the bulging portion 20*a* is bulging toward the Z1 side, and the leg portions 20*c* support the bulging portion 20*a* at a predetermined height position. Note that, the bulging portion 20*a* and the first fixed contact portion 10*a* are not in contact with each other in an initial state. Here, when an operation force is applied, as illustrated in FIG. 4 (*b*), the leg portions 20*c* first elastically deform and deflect, and the outer peripheral portion of the bulging portion 20*a* contacts the internal bottom surface 51*a*. When the operation force is further increased, the bulging portion 20*a* is inverted such that, as illustrated in FIG. 4 (*c*), the inverted bulging portion 20*a* comes into contact with the first fixed contact portion 10*a*, and the first fixed contact portion 10*a* and the second fixed contact portions 10*b* are electrically conducted. A relationship between the operation amount and the operation force in the push switch 1 of the present embodiment is as illustrated in the graph of FIG. 5. That is, a first operation force F1 at a first operation amount S1 immediately after pressing from the initial state (i.e., operation amount of zero) is a very small value due to the elastic deformation of the leg portions 20*c*. When a peak load of an operation force is defined as F3 and an operation amount at the inversion operation of the bulging portion is defined as a second operation amount S2, the peak load F3 is 1.5 N and the second operation amount S2 is 0.18 mm, the first operation amount S1 is 0.025 mm, and the first operation force F1 is 0.2 N.

Note that, also according to prior art, a movable contact member having leg portions extending outward from the bulging portion was used, but these leg portions are not considered to elastically deform themselves. The leg portions according to the prior art, which are designed such that the leg portions are a part of the bulging part and thus deform integrally with the inversion operation of the bulging part, differ from the leg portions 20*c* according to the present embodiment in a shape and a mechanical characteristic. As a comparative example, a relationship between an operation amount and an operation force according to a conventional push switch will be described. FIG. 8 is a graph illustrating a relationship between an operation amount and an operation force in the conventional push switch.

According to the conventional push switch, as illustrated in FIG. 8, immediately after pressing from the initial state, the operation load rapidly increases. Therefore, it is usually expressed as a load curve in which the operation load increases immediately after pressing operation. In addition, the bulging portion starts to inverse at the operation amount associated with the peak load, and then the operation load decreases. If the pressing operation continues beyond the operation amount that completes the inversion of the bulging portion, the movable contact member cannot be elastically deformed, and thus the operating load rapidly increases.

In the push switch 1 of the present embodiment, as illustrated in FIG. 6, the principle of operation can be explained by dividing an operation load into an operation load (FIG. 6 (*a*)) of the bulging portion 20*a* and an operation load of the leg portions 20*c* (FIG. 6 (*b*)). If the leg portions 20*c* are not provided, as illustrated in FIG. 6 (*a*), the operation load increases almost linearly from the initial state (in which an operation amount is 0) to the peak load F3. On the other hand, when only the leg portions 20*c* are elastically deformed, as illustrated in FIG. 6 (*b*), it is possible to press until the first operation amount S1 with a decreased force of the first operation force F1 but the leg portions 20*c* cannot further bends thereafter, which causes the operation load to rapidly increase. In the push switch 1 of the present embodiment, the deflection due to the elastic deformation of the leg portions 20*c* illustrated in FIG. 6 (*b*) exerts an influence upon the operation amount, and the graph illustrated in FIG. 5 is obtained.

Then, when the push switch 1 of the present embodiment is released from the pressing operation state, the push switch 1 returns to the initial state with a slight hysteresis according to the operation load illustrated in FIG. 5. At this time, the bulging portion 20*a*, which has restored to the first operation amount S1, has the inversion operation energy remained in the state of the mechanical vibration energy of the movable contact member 20. Therefore, the movable contact member 20 vibrates. However, in the push switch 1 of this embodiment, the leg portions 20*c* return to the initial state from the elastic deformation, which absorbs the vibration energy to attenuate the vibration.

As described above, in the push switch 1 of the present embodiment, the leg portions 20*c* absorb the vibration as the vibration damping members 25. When operating from the initial state, the vibration damping members 25 flex due to its elastic deformation, and the operation force at the time of elastic deformation of the vibration damping members 25 monotonically increases. Then, when restoring from the inversion state of the bulging portion 20*a* to the initial state, the vibration damping members 25 absorb the vibration of the movable contact member 20. Note that, since the sheet member 30 is disposed so as to be in contact with the bulging portion 20*a*, the vibration of the movable contact member 20 can be absorbed also on the sheet member 30 side. In the push switch 1 of the present embodiment, as described above, by providing the leg portions 20*c* as the vibration damping members 25, the vibration damping members 25 absorb vibrations and the like when the movable contact member 20 returns to the initial state, which can suppress generation of operation sound and thus further noise reduction can be achieved.

In order to obtain this effect, the amount of the elastic deformation of the leg portions 20*c* is required to be great to some extent. As a result of examination in the present embodiment, it has been found that it is necessary to provide the leg portions 20*c* as the vibration damping members 25 as described below.

Assume that an operation amount caused by an elastic deformation of the vibration damping members 25 is a first operation amount S1, an operation force at the first operation amount is a first operation force F1, an operation force immediately before a start of the inversion operation of the bulging portion 20*a* is a peak load F3, and an operation amount at the inversion operation of the bulging portion 20*a* is a second operation amount S2, the first operation amount S1 is greater than 0.015 mm and within a range between one-fifth and one-tenth of the second operation amount S2, and the first operation force F1 is within 30% of the peak load F3. Further, it is preferable that the first operation force F1 is smaller than the operating load at the second operating amount S2.

Note that if the leg portions are hard to be elastically deformed, it is difficult to define the first operation force F1 because the first operation amount S1 becomes ambiguous. In addition, if the first operation force F1 is a relatively great value as compared with the peak load F3 immediately before the bulging portion 20*a* starts the inversion operation, the movement of the leg portions is hard and the vibration cannot be absorbed. In such a case, the vibration damping effect of the present embodiment cannot be obtained.

Hereinafter, effects of the present embodiment will be described.

The push switch 1 of the present embodiment comprises the movable contact member 20 having a dome-shaped bulging portion 20*a* formed of a metal plate and capable of the inversion operation, the fixed contact member 10 capable of electrically connecting to the movable contact member 20, and the housing 50 that houses the movable contact member 20 and has the housing portion 51 with the opening on one side thereof. Further, the fixed contact member 10 includes the first fixed contact portion 10*a* provided at the central portion of the internal bottom surface 51*a* of the housing portion 51 and capable of being brought into and out of contact with the movable contact member 20 and the second fixed contact portions 10*b* provided at the outer edge portion of the internal bottom surface 51*a*. The vibration damping members 25 are further provided, which are elastically deformable with the operation force lower than the reversing operation load of the bulging portion 20*a* and has conductivity, and the bulging portion 20*a* and the second fixed contact portions 10*b* are electrically connected via the vibration damping members 25. When operating from the initial state, the vibration damping members 25 flex due to its elastic deformation, and the operation force at the time of elastic deformation of the vibration damping members 25 monotonically increases. Then, when restoring from the inversion state of the bulging portion 20*a* to the initial state, the vibration damping members 25 absorb the vibration of the movable contact member 20.

According to this configuration, by providing the vibration damping members 25, the vibration damping members 25 absorb vibrations and the like when the movable contact member 20 returns to the initial state, which can suppress generation of operation sound and thus noise reduction can be achieved.

Further, according to the push switch 1 of the present embodiment, when an operation amount caused by an elastic deformation of the vibration damping members 25 is a first operation amount S1, an operation force at the first operation amount is a first operation force F1, an operation force immediately before a start of the inversion operation of the bulging portion 20*a* is a peak load F3, and an operation amount at the inversion operation of the bulging portion 20*a* is a second operation amount S2, the first operation amount S1 is greater than 0.015 mm and within a range between one-fifth and one-tenth of the second operation amount S2, and the first operation force F1 is within 30% of the peak load F3.

According to this configuration, since the operation force at the time of the elastic deformation of the vibration damping members 25 monotonically increases and the load is small, the noise can be reduced without impairing the operation feeling.

Further, according to the push switch 1 of the present embodiment, the movable contact member has at least two leg portions 20*c* extending outward from the bulging portion 20*a*, and the leg portions 20*c* are the vibration damping members 25.

According to this configuration, assembling becomes easy with the reduced number of component parts.

Further, the push switch 1 of the present embodiment further includes the sheet member 30 that covers the housing portion 51, and is disposed so that the sheet member 30 is in contact with the bulging portion 20*a*.

According to this configuration, since the sheet member 30 is disposed so as to be in contact with the bulging portion 20*a*, the vibration of the movable contact member 20 can be absorbed also on the sheet member 30 side. Further, the sheet member 30 can stably invert the bulging portion 20*a* of the movable contact member 20 at the time of pressing operation. Further, since the sheet member 30 covers the housing portion 51, it is possible to prevent invasion of foreign matter which may interfere with an operation of the movable contact member 2.

As described above, the push switch 1 according to the embodiment of the present invention has been concretely described. However, the present invention is not limited to the above-described embodiment, but various modifications may be made without departing from the gist. For example, it can be modified by the following modifications, which are also within the technical scope of the present invention.

Figure 7:
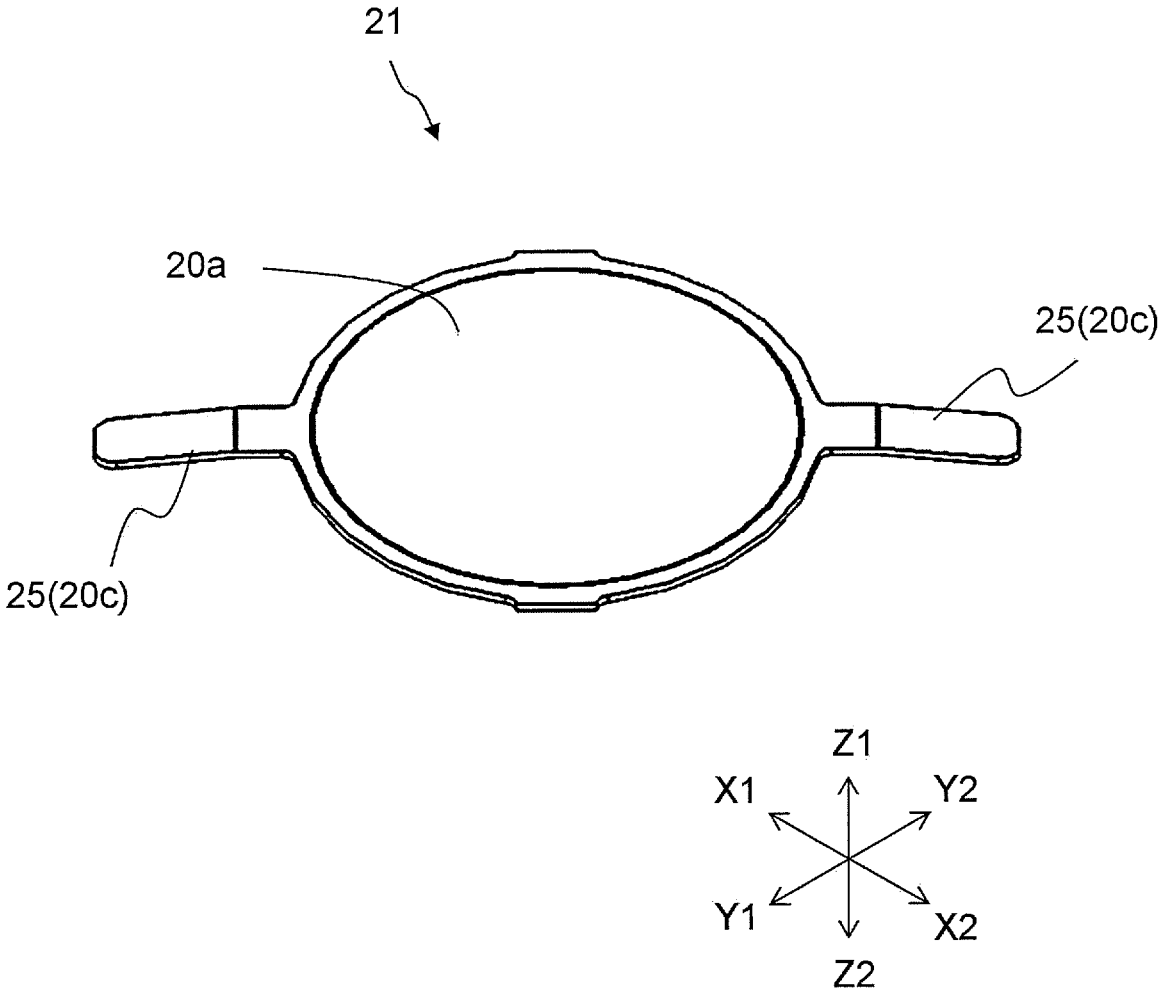
FIG. 7 is a perspective view illustrating a movable contact member according to a modified example.

(1) In the present embodiment, the leg portions 20*c* are four, and two of the leg portions 20*c* are used to electrically connect the bulging portion 20*a* and the second fixed contact portions 10*b*. However, the electrical connection between the bulging portion 20*a* and the second fixed contact portions 10*b* may be implemented by only one leg portion 20*c*. Further, in order to act stably as the vibration damping members 25, two vibration damping members 25 may suffice to support the structure. FIG. 7 is a perspective view illustrating a movable contact member 21 according to a modified example, in which two vibration damping members 25 are used. Further, three or more vibration damping members 25 may be formed.

(2) In the present embodiment, the leg portions 20*c* are elastically deformed to be deflected and the outer peripheral portion of the bulging portion 20*a* comes into contact with the internal bottom surface 51*a*. However, the deflection of the leg portions 20*c* is not limited to such a manner. For example, the inversion operation of the bulging portion 20*a* may be started in a state in which the deflection of the leg portions 20*c* stays in the middle and the outer peripheral portion of the bulging portion 20*a* does not contact the internal bottom surface 51*a*. In addition, parts of the leg portions 20*c* may be configured such that the parts easily undergo elastic deformation, and those parts may act as the vibration damping member 25.

(3) In the present embodiment, the vibration damping members 25 are integrated with the movable contact member 20, but the present invention is not limited to this as long as the effect due to the vibration damping members 25 can obtained. For example, the vibration damping members 25 may be provided on the side of the second fixed contact portions 10*b*.

What is claimed is:

1. A push switch, comprising:

a movable contact member formed of a metal plate and having a dome-shaped bulging portion, the bulging portion being capable of an inversion operation;

a fixed contact member capable of electrically coupling to the movable contact member; and a housing having a housing portion in which the movable contact member is accommodated, the housing portion having an opening at one side thereof; wherein the fixed contact member has a first fixed contact portion and a second fixed contact portion, the first fixed contact portion being provided on an internal bottom surface of the housing portion and capable of being brought into and out of contact with the movable contact member, the second fixed contact portion being provided at an outer edge portion of the internal bottom surface, the push switch further comprises an electrically conductive vibration damping member that is elastically deformable by an operating force lower than a load required for the inversion operation of the bulging portion, the bulging portion and the second fixed contact portion being electrically coupling to each other via the vibration damping member, the movable contact member further includes at least two leg portions that extend outward from the bulging portion and constitute the vibration damping member, each of the leg portions having a shape that becomes narrower in a direction in which the each of the leg portions extends, the movable contact member is configured such that the vibration damping member first elastically deforms when the operating force is applied to the movable contact member in an initial state, then only the bulging portion is inverted when the operating force is increased, and the operating force for elastically deforming the vibration damping member increases monotonically, when the bulging portion is returned to its initial state from an inverted state, the vibration damping member absorbs a vibration of the movable contact member, an operation amount caused by an elastic deformation of the vibration damping member is a first operation amount, an operating force at the first operation amount is a first operating force, an operating force immediately before a start of the inversion operation of the bulging portion is a peak load, an operation amount at the inversion operation of the bulging portion is a second operation amount, the first operation amount is greater than 0.015 mm and within a range between one-fifth and one-tenth of the second operation amount, and the first operating force is less than or equal to 30% of the peak load.

2. The push switch of claim 1, further comprising a sheet member covering the housing portion, the sheet member being provided such that the sheet member is in contact with the bulging portion.

3. The push switch of claim 1, further comprising a sheet member covering the housing portion, the sheet member being provided such that the sheet member is in contact with the bulging portion.

* * * * *